US006494849B2

(12) United States Patent
Kuo

(10) Patent No.: US 6,494,849 B2
(45) Date of Patent: Dec. 17, 2002

(54) MASSAGE DEVICE

(76) Inventor: Shu-Yu Kuo, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/908,537

(22) Filed: Apr. 23, 2001

(65) Prior Publication Data

US 2002/0156404 A1 Oct. 24, 2002

(51) Int. Cl.[7] ..... A61H 15/00
(52) U.S. Cl. ..... 601/27; 601/85; 601/112; 601/113
(58) Field of Search ..... 601/112, 113, 601/115, 116, 122, 126, 128, 27–29, 32, 84–87

(56) References Cited

U.S. PATENT DOCUMENTS 4,432,355 A * 2/1984 Delluc
5,797,859 A * 8/1998 Prehodka
5,827,205 A * 10/1998 Iwamoto
6,149,611 A * 11/2000 Chen

* cited by examiner

*Primary Examiner*—Justine R. Yu
(74) *Attorney, Agent, or Firm*—Alan D. Kamrath; Rider, Bennett, Egan & Arundel

(57) ABSTRACT

A massage device has a base casing, a cover casing engaging with the base casing, a driving mechanism disposed in the base casing, at least a rotating disk, and at least a massage ball set. The driving mechanism has a motor and at least a gear disk driven by the motor. A shaft is disposed on the gear disk. The massage ball set has a main rod, a three-way frame disposed on the main rod, and three rolling balls disposed on the three-way frame. The shaft is driven by the gear disk. The rotating disk is driven by the shaft. The massage ball set is driven by the rotating disk.

3 Claims, 6 Drawing Sheets

MASSAGE DEVICE

BACKGROUND OF THE INVENTION

The present invention relates to a massage device. More particularly, the present invention relates to a massage device which has a plurality of rolling balls.

A conventional foot massage machine has a complex mechanism. Therefore, the conventional foot massage machine is easily broken after a long period of usage.

SUMMARY OF THE INVENTION

An object of the present invention is to provide a massage device which has a plurality of rolling balls to massage a user conventiently.

Accordingly, a massage device comprises a base casing, a cover casing engaging with the base casing, a driving mechanism disposed in the base casing, at least a rotating disk, and at least a massage ball set. The cover casing has at least a through hole and an upper treading portion having a plurality of protrusions. The driving mechanism has a motor and at least a gear disk driven by the motor. A shaft is disposed on the gear disk. The rotating disk has a center aperture, and a lower collar having a lower round hole, a threaded aperture communicating with the lower round hole, and a threaded hole communicating with the center aperture of the rotating disk. The shaft is inserted in the lower round hole of the lower collar. The massage ball set has a main rod, a three-way frame disposed on the main rod, and three rolling balls disposed on the three-way frame. The main rod is inserted in the center aperture of the rotating disk. The rolling balls pass through the through hole of the cover casing. A first bolt is inserted in the threaded aperture of the lower collar. A second bolt is inserted in the threaded hole of the lower collar.

DETAILED DESCRIPTION OF THE INVENTION

Figure 1:
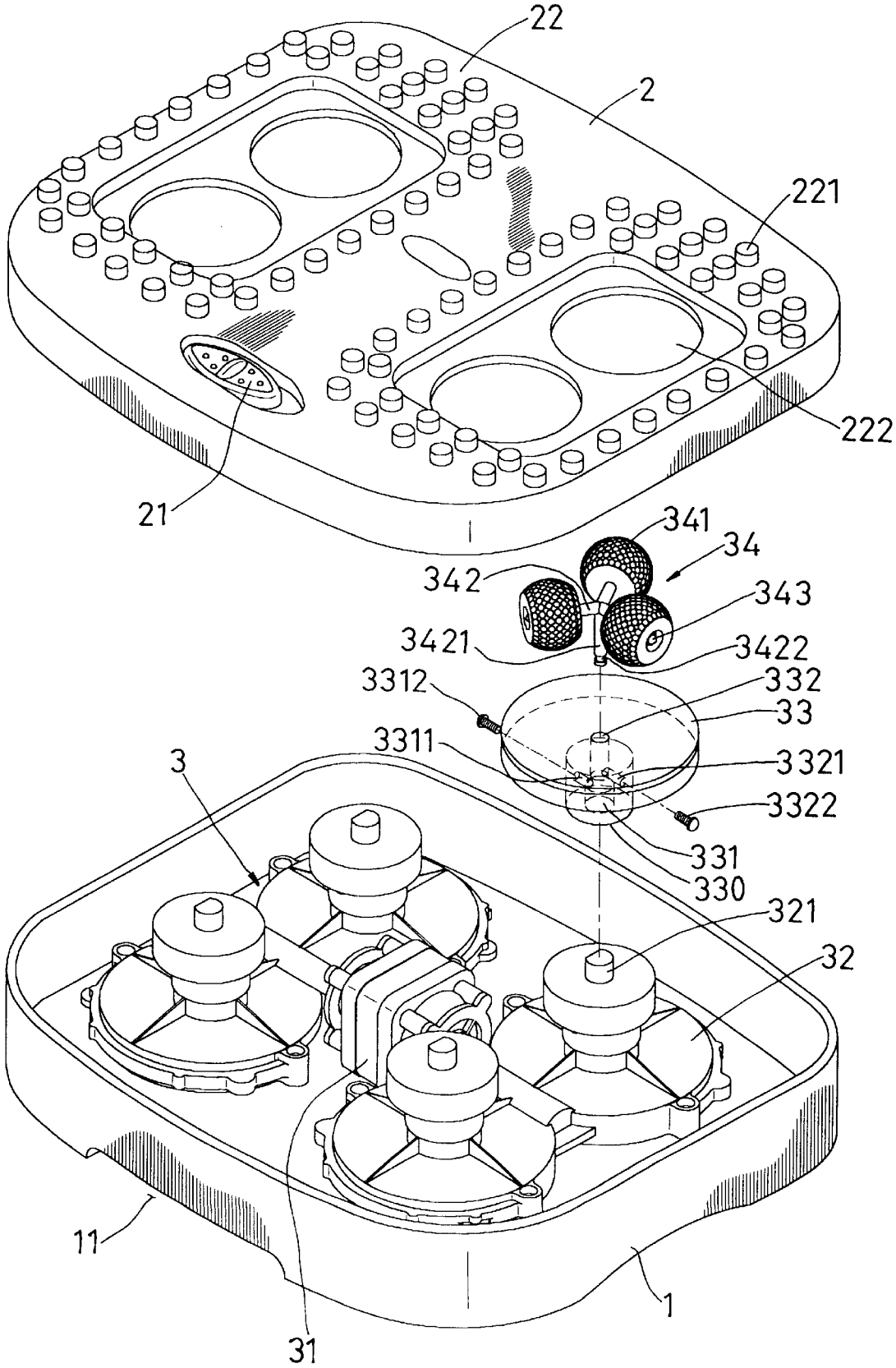
FIG. 1 is a perspective exploded view of a massage device of a first preferred embodiment in accordance with the present invention.
Figure 2:
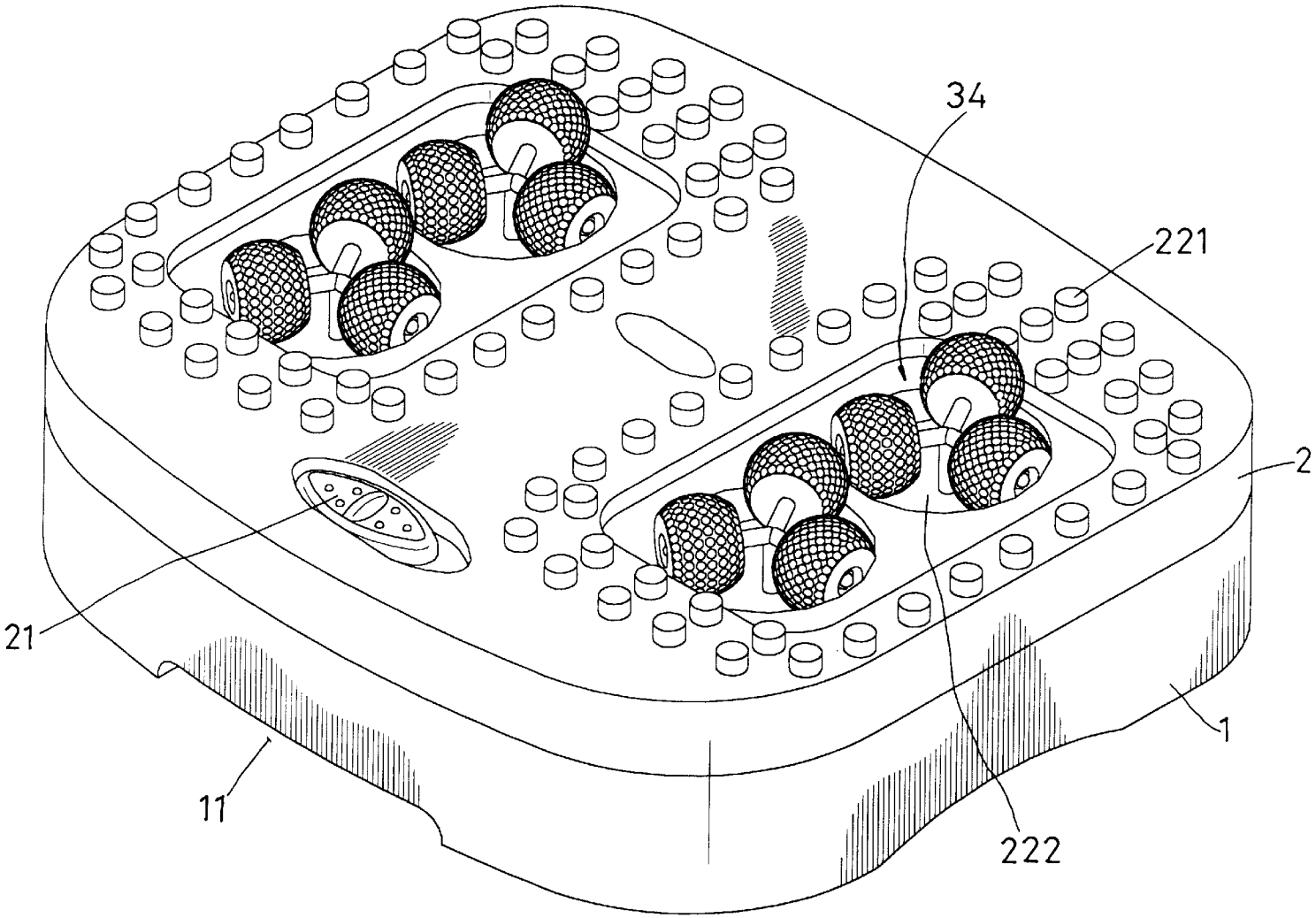
FIG. 2 is a perspective assembly view of a massage device of a first preferred embodiment in accordance with the present invention.
Figure 3:
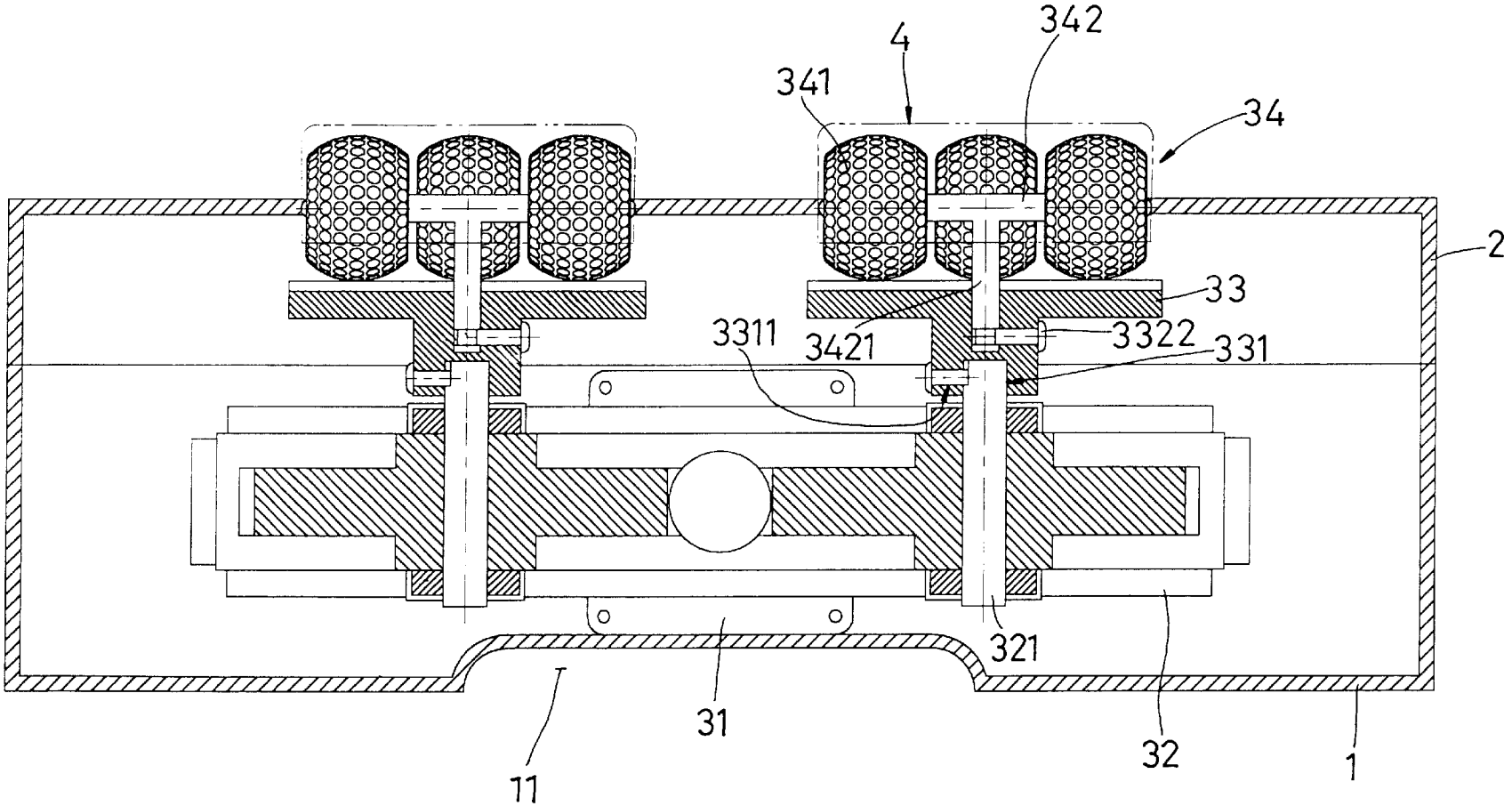
FIG. 3 is a sectional assembly view of a massage device of a first preferred embodiment in accordance with the present invention.

Referring to FIGS. 1 to 3, a first massage device comprises a base casing 1, a cover casing 2 engaging with the base casing 1, a driving mechanism 3 disposed in the base casing 1, at least a rotating disk 33, and at least a massage ball set 34.

The cover casing 2 has a switch 21, at least a through hole 222, and an upper treading portion 22 having a plurality of protrusions 221.

The driving mechanism 3 has a motor 31 and at least a gear disk 32 driven by the motor 31.

A shaft 321 is disposed on the gear disk 32.

The rotating disk 33 has a center aperture 332, and a lower collar 330 having a lower round hole 331, a threaded aperture 3311 communicating with the lower round hole 331, and a threaded hole 3321 communicating with the center aperture 332 of the rotating disk 33.

The shaft 321 is inserted in the lower round hole 331 of the lower collar 330.

The massage ball set 34 has a main rod 3421, a three-way frame 342 disposed on the main rod 3421, and three rolling balls 341 disposed on the three-way frame 342.

The main rod 3421 is inserted in the center aperture 332 of the rotating disk 33.

The rolling balls 341 pass through the through hole 222 of the cover casing 2.

A first bolt 3312 is inserted in the threaded aperture 3311 of the lower collar 330.

A second bolt 3322 is inserted in the threaded hole 3321 of the lower collar 330.

The main rod 3421 has an end annular groove 3422 to receive the second bolt 3322.

The base casing 1 has a bottom recess 11.

It is an option to provide a protection cover 4 to cover the massage ball set 34.

The shaft 321 is driven by the gear disk 32. The rotating disk 33 is driven by the shaft 321. The massage ball set 34 is driven by the rotating disk 33.

Figure 4:
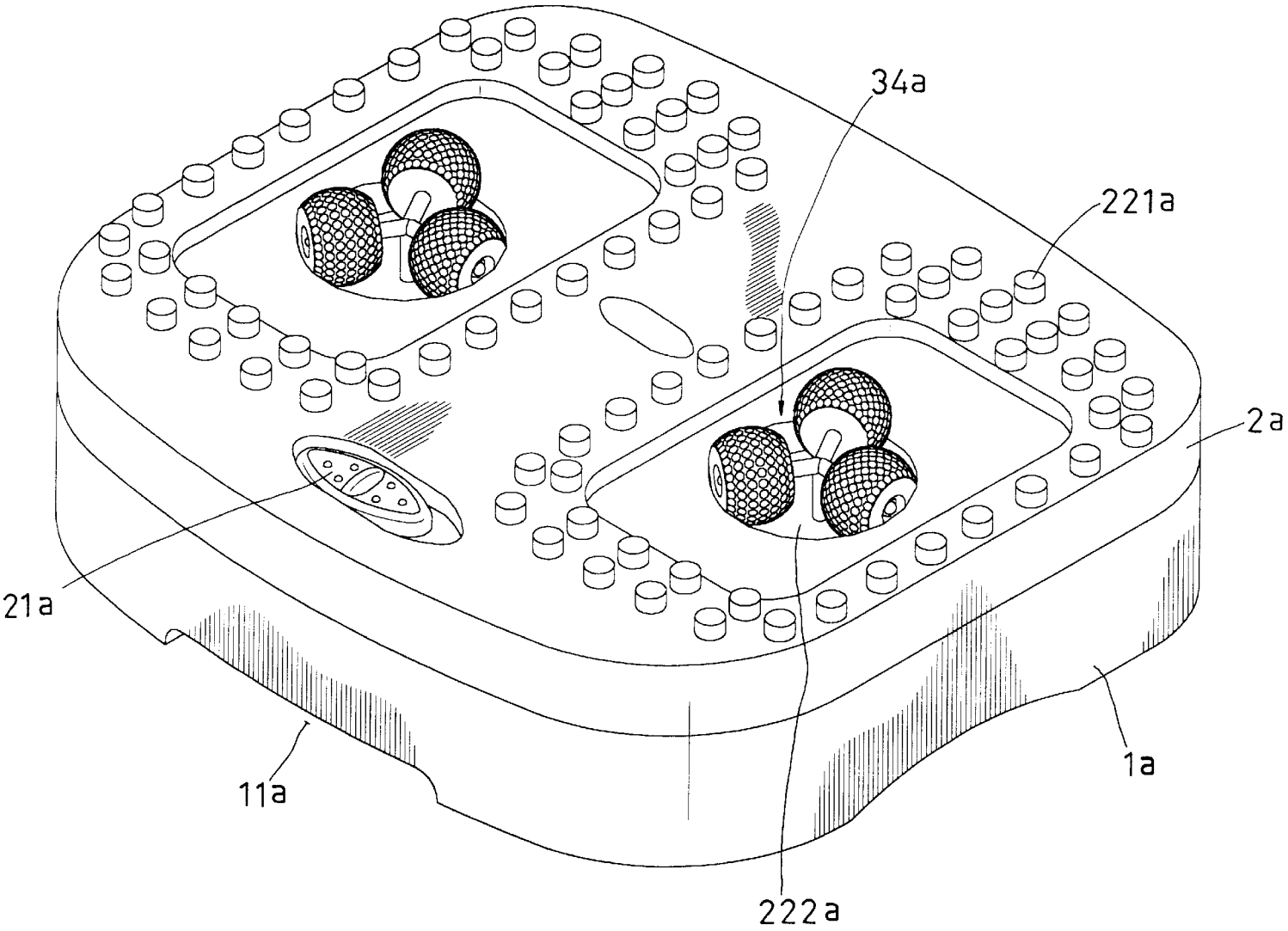
FIG. 4 is a perspective assembly view of a massage device of a second preferred embodiment in accordance with the present invention.

Referring to FIG. 4, a second massage device comprises a base casing 1*a,* a cover casing 2*a* engaging with the base casing 1*a,* and two massage ball sets 34*a.*

The cover casing 2*a* has a switch 21*a,* two through holes 222*a,* and a plurality of protrusions 221*a.*

Figure 5:
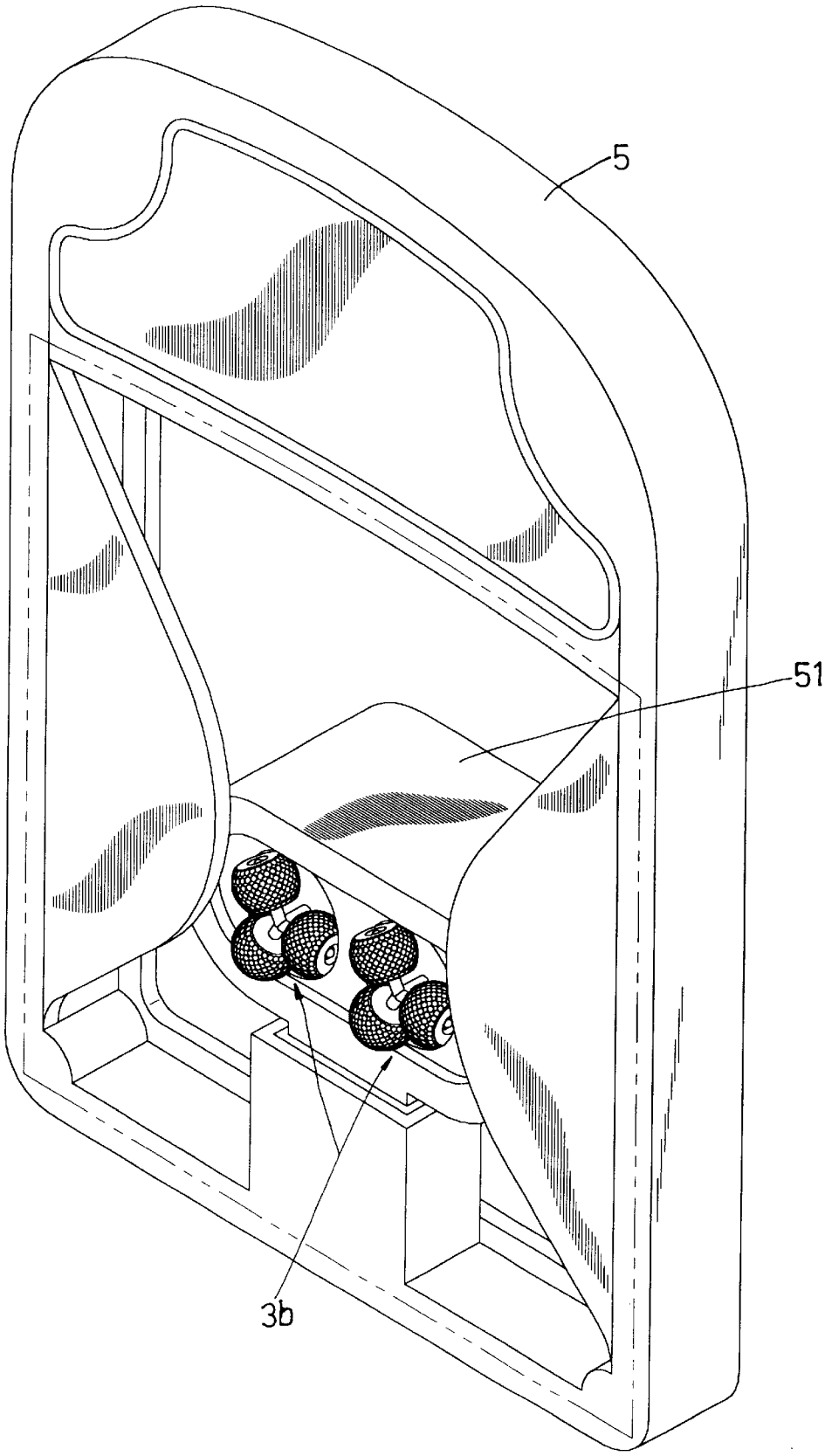
FIG. 5 is a perspective schematic view illustrating a massage device of a second preferred embodiment disposed in a backrest.
Figure 6:
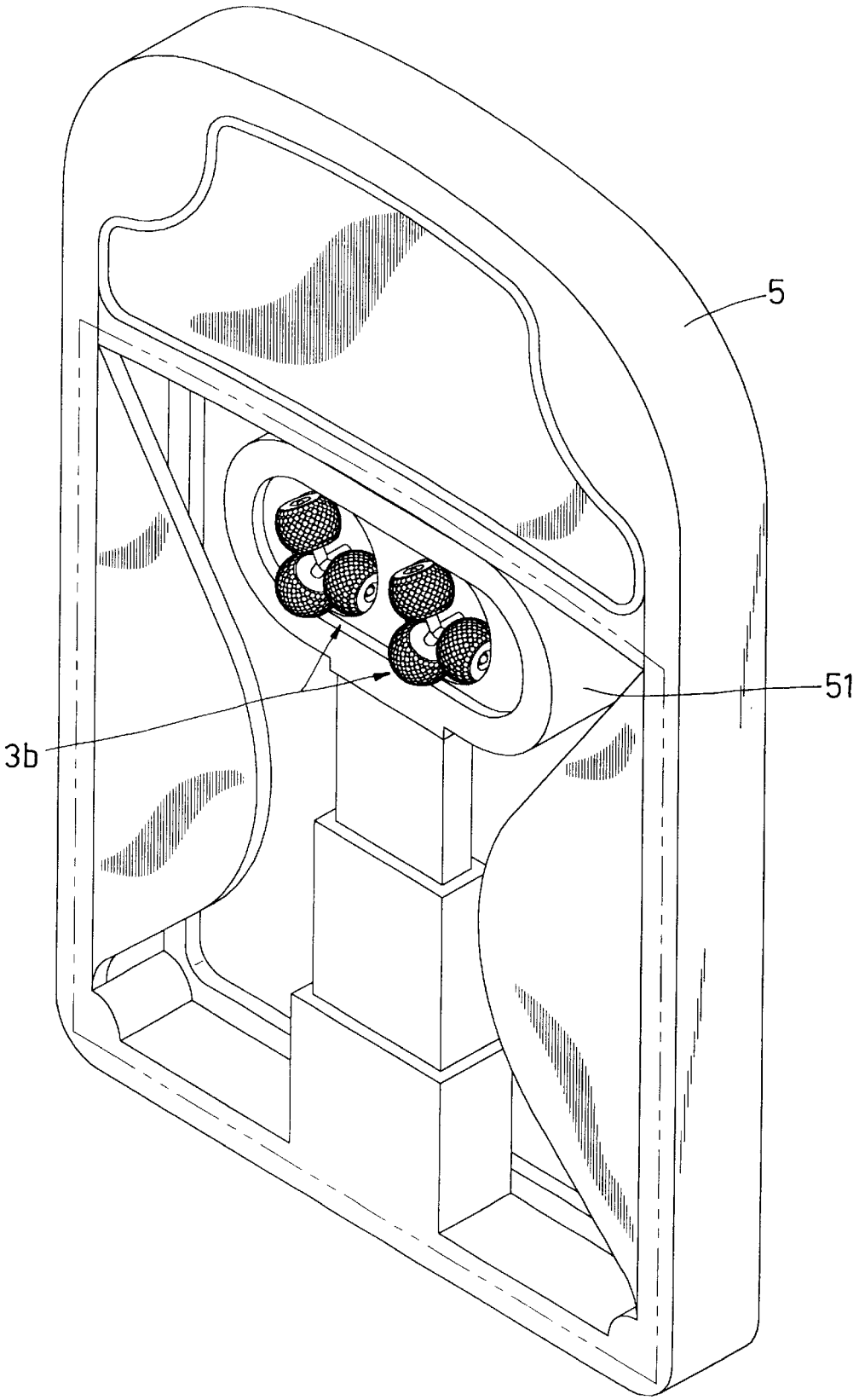
FIG. 6 is another perspective schematic view illustrating a massage device of a second preferred embodiment disposed in a backrest.

Referring to FIGS. 5 and 6, a chair backrest 5 has an elevator device 51. Two massage ball sets 34*b* are disposed in the elevator device 51.

The present invention is not limited to the above embodiments but various modification thereof may be made. Furthermore, various changes in form and detail may be made without departing from the scope of the present invention.

I claim:

1. A massage device comprises:

a base casing, a cover casing engaging with the base casing, a driving mechanism disposed in the base casing, at least a rotating disk, and at least a massage ball set, the cover casing having at least a through hole and an upper treading portion having a plurality of protrusions, the driving mechanism having a motor and at least a gear disk driven by the motor, a shaft disposed on the gear disk, the rotating disk having a center aperture, and a lower collar having a lower round hole, a threaded aperture communicating with the lower round hole, and a threaded hole communicating with the center aperture of the rotating disk, the shaft inserted in the lower round hole of the lower collar, the massage ball set having a main rod, a three-way frame disposed on the main rod, and three rolling balls disposed on the three-way frame, the main rod inserted in the center aperture of the rotating disk, the rolling balls passing through the through hole of the cover casing, a first bolt inserted in the threaded aperture of the lower collar, and a second bolt inserted in the threaded hole of the lower collar.

2. The massage device as claimed in claim 1, wherein the main rod has an end annular groove.

3. The massage device as claimed in claim 1, wherein the base casing has a bottom recess.

* * * * *